US009258865B2

(12) United States Patent
Hsu et al.

(10) Patent No.: US 9,258,865 B2
(45) Date of Patent: Feb. 9, 2016

(54) LOW-FLICKERLIGHT-EMITTING DIODE LIGHTING DEVICE HAVING MULTIPLE DRIVING STAGES

(71) Applicant: IML International, Grand Cayman (KY)

(72) Inventors: Horng-Bin Hsu, Taipei (TW); Yi-Mei Li, New Taipei (TW); Yung-Hsin Chiang, New Taipei (TW)

(73) Assignee: IML International, Grand Cayman (KY)

( * ) Notice: Subject to any disclaimer, the term of this patent is extended or adjusted under 35 U.S.C. 154(b) by 0 days.

(21) Appl. No.: 14/700,165

(22) Filed: Apr. 30, 2015

(65) Prior Publication Data

US 2015/0245442 A1 Aug. 27, 2015

Related U.S. Application Data

(63) Continuation-in-part of application No. 14/267,916, filed on May 2, 2014, now Pat. No. 9,084,315.

(60) Provisional application No. 61/991,627, filed on May 12, 2014, provisional application No. 61/844,438, filed on Jul. 10, 2013.

(51) Int. Cl.
*H05B 33/08* (2006.01)

(52) U.S. Cl.
CPC ..... *H05B 33/0851* (2013.01); *H05B 33/0809* (2013.01); *H05B 33/0815* (2013.01); *H05B 33/0845* (2013.01)

(58) Field of Classification Search
CPC ..... H05B 33/0815; H05B 33/0845; H05B 33/0824; H05B 33/08; H05B 37/029; Y02B 20/347
See application file for complete search history.

(56) References Cited

U.S. PATENT DOCUMENTS

| | | | | |
|---|---|---|---|---|
| 2012/0146519 | A1* | 6/2012 | Briggs | H05B 33/0857 315/192 |
| 2012/0256550 | A1* | 10/2012 | Akiyama | H05B 33/0824 315/187 |
| 2013/0200812 | A1* | 8/2013 | Radermacher | H05B 33/08 315/186 |
| 2014/0139125 | A1* | 5/2014 | Lee | H05B 33/0824 315/186 |

FOREIGN PATENT DOCUMENTS

| | | | |
|---|---|---|---|
| JP | 2009283775 | | 12/2009 |
| KR | 1020120082468 | A | 7/2012 |
| KR | 1020130042015 | A | 4/2013 |
| KR | 101267957 | B1 | 5/2013 |
| TW | 201143510 | | 12/2011 |
| TW | M431266 | | 6/2012 |

* cited by examiner

*Primary Examiner* — Douglas W Owens
*Assistant Examiner* — Raymond R Chai
(74) *Attorney, Agent, or Firm* — Winston Hsu; Scott Margo

(57) ABSTRACT

An LED lighting device includes multiple luminescent devices driven by a rectified AC voltage. The multiple luminescent devices are turned on flexibly in a multi-stage driving scheme using multiple current control units. At least one charge storage unit is coupled in parallel with at least one luminescent device. When the rectified AC voltage is still insufficient to turn on the at least one luminescent device, the at least charge storage unit is configured to discharge energy to the at least one luminescent device, thereby keeping the at least one luminescent device turned on.

18 Claims, 16 Drawing Sheets

LOW-FLICKERLIGHT-EMITTING DIODE LIGHTING DEVICE HAVING MULTIPLE DRIVING STAGES

CROSS REFERENCE TO RELATED APPLICATIONS

This application is a Continuation in Part of U.S. non-provisional application Ser. No. 14/267,916 filed on May 2, 2014 which claims the benefit of U.S. provisional application No. 61/844,438 filed on Jul. 10, 2013. This application claims the benefit of U.S. provisional application No. 61/991,627 filed on May 12, 2014.

BACKGROUND OF THE INVENTION

1. Field of the Invention

The present invention is related to an LED lighting device having multiple driving stages, and more particularly, to an LED lighting device having multiple driving stages for providing wide effective operational voltage range without causing flicker and uniformity issue.

2. Description of the Prior Art

An LED lighting device directly driven by a rectified alternative-current (AC) voltage usually adopts a plurality of LEDs coupled in series in order to provide required luminance. As the number of the LEDs increases, a higher forward-bias voltage is required for turning on the LED lighting device, thereby reducing the effective operational voltage range of the LED lighting device. As the number of the LEDs decreases, the large driving current when the rectified voltage is at its maximum level may impact the reliability of the LEDs.

An LED lighting device is configured to modulate luminous flux and intensity. This time variation is commonly referred to as flicker. LED flicker, whether perceptible or not, has been a concern of the lighting community because of its potential human impacts, which range from distraction, mild annoyance to neurological problems. Therefore, there is a need for an LED lighting device capable of improving the effective operational voltage range, the reliability and the flicker phenomenon.

SUMMARY OF THE INVENTION

The present invention provides an LED lighting device having a first driving stage and a second driving stage. The first driving stage includes a first luminescent device driven by a rectified AC voltage for providing light according to first current; a second luminescent device driven by the rectified AC voltage for providing light according to second current; a first current controller coupled in series to the first luminescent device and configured to regulate the first current so that the first current does not exceed a first value; a second current controller coupled in series to the second luminescent device and configured to regulate the second current so that the second current does not exceed a second value; a first charge storage unit coupled in parallel with at least the first luminescent device and configured to discharge energy to the first luminescent device when the rectified AC voltage is insufficient to turn on the first luminescent device, thereby keeping the first luminescent device turned on; and a path-controller configured to conduct third current and having a first end coupled between the first luminescent device and the first current controller and a second end coupled to the second current controller. The second driving stage includes a third current controller coupled in series to the first driving stage and configured to conduct fourth current and regulate the fourth current so that the fourth current does not exceed a third value.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
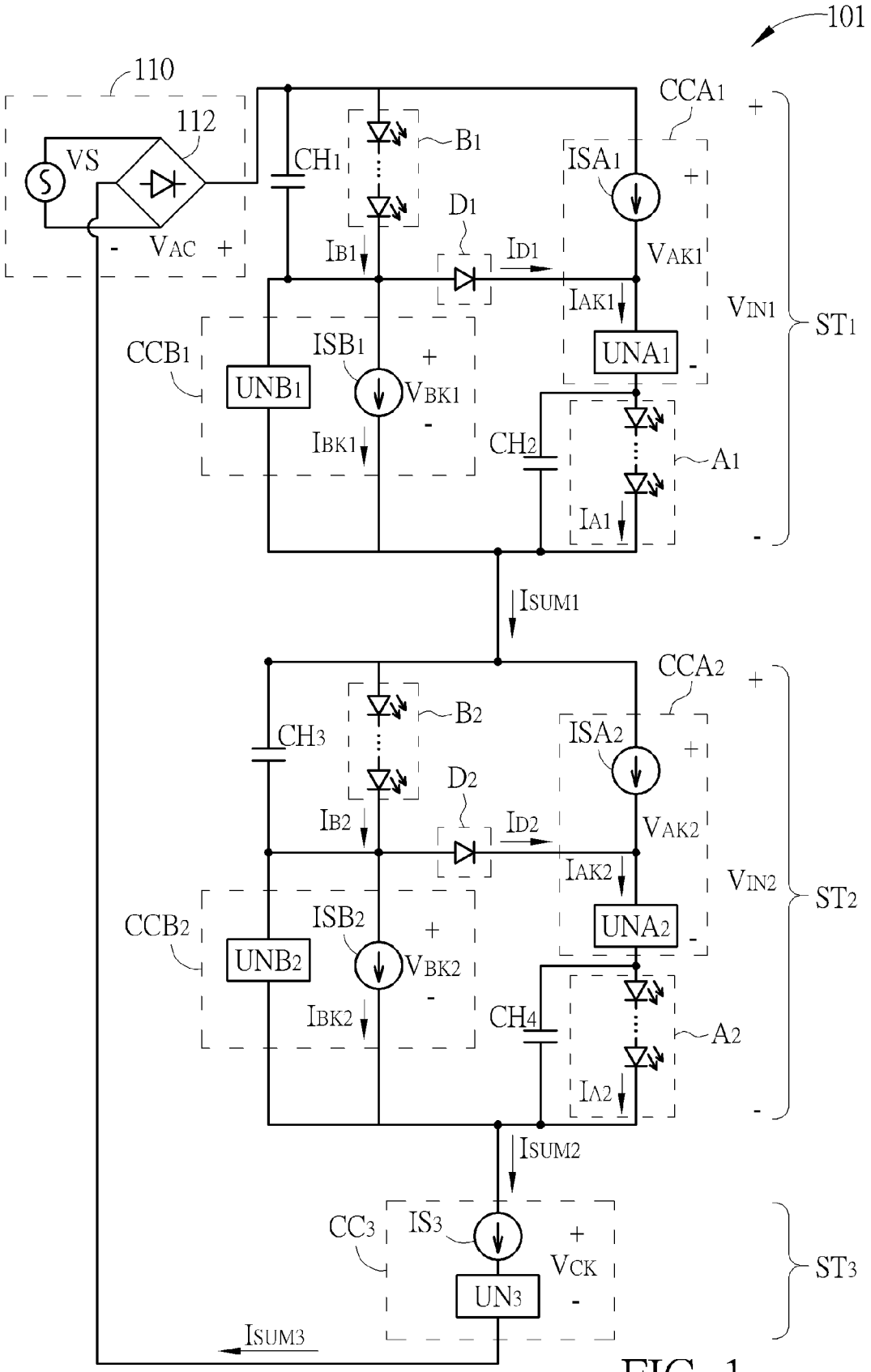
FIGS. 1~4 are diagrams of LED lighting devices according to embodiments of the present invention.

FIGS. 1-4 are diagrams of LED lighting devices 101-104 according to embodiments of the present invention. Each of the LED lighting devices 101-104 includes a power supply circuit 110 and (N+1) driving stages $ST_1$~$ST_{N+1}$. The power supply circuit 110 is configured to receive an AC voltage VS having positive and negative periods and convert the output of the AC voltage VS in the negative period using a bridge rectifier 112, thereby providing a rectified AC voltage $V_{AC}$, whose value varies periodically with time, for driving the (N+1) driving stages. In another embodiment, the power supply circuit 110 may receive any AC voltage VS, perform voltage conversion using an AC-AC converter, and rectify the converted AC voltage VS using the bridge rectifier 112, thereby providing the rectified AC voltage $V_{AC}$ whose value varies periodically with time. The configuration of the power supply circuit 110 does not limit the scope of the present invention.

In the LED lighting devices 101~103, each of the $1^{st}$ to $N^{th}$ driving stages $ST_1$~$ST_N$ includes a plurality of luminescent devices, a path controller, a first-type current controller, a second-type current controller, and M charge storage units $CH_1$~$CH_M$, wherein N is a positive integer larger than 1, and M is a positive integer smaller or equal to 2N. The $(N+1)^{th}$ driving stage $ST_{N+1}$ includes a third-type current controller.

In the LED lighting device 104, the $1^{st}$ driving stage $ST_1$ includes a plurality of luminescent devices, while each of the $2^{nd}$ to $N^{th}$ driving stages $ST_2$~$ST_N$ includes a plurality of luminescent devices, a path controller, a first-type current controller, a second-type current controller, and M charge storage units $CH_1$~$CH_M$, wherein N is a positive integer larger than 1, and M is a positive integer smaller or equal to 2N. The $(N+1)^{th}$ driving stage $ST_{N+1}$ includes a third-type current controller.

Each first-type current controller includes an adjustable current source and a current detection and control unit. Each second-type current controller includes an adjustable current source and a voltage detection and control unit. The third-type current controller includes an adjustable current source and a detection and control unit.

For illustrative purposes, the following symbols are used to represent each device in the LED lighting devices 101-104 throughout the description and figures. $A_1$~$A_N$ and $B_1$~$B_N$ represent the luminescent devices in the corresponding driving stages $ST_1$~$ST_N$, respectively. $D_1$~$D_N$ represent the path-controllers in the corresponding driving stages $ST_1$~$ST_N$, respectively. $CCA_1$~$CCA_N$ represent the first-type current controllers in the corresponding driving stages $ST_1$~$ST_N$, respectively. $CCB_1$~$CCB_N$ represent the second-type current controllers in the corresponding driving stages $ST_1$~$ST_N$, respectively. $CC_{N+1}$ represents the third-type current controller in the $(N+1)^{th}$ driving stage $ST_{N+1}$. $ISA_1$~$ISA_N$ represent the adjustable current sources in the corresponding first-type current controllers $CCA_1$~$CCA_N$, respectively. $ISB_1$~$ISB_N$ represent the adjustable current sources in the corresponding second-type current controllers $CCB_1$~$CCB_N$, respectively. $IS_{N+1}$ represents the adjustable current source in the third-type current controller $CC_{N+1}$. $UNA_1$~$UNA_N$ represent the current detection and control units in the corresponding first-type current controllers $CCA_1$~$CCA_N$ respectively. $UNB_1$~$UNB_N$ represent the voltage detection and control units in the corresponding second-type current controllers $CCB_1$~$CCB_N$, respectively. $UN_{N+1}$ represents the detection and control unit in the $(N+1)^{th}$ driving stage $ST_{N+1}$.

For illustrative purposes, the following symbols are used to represent related current/voltage in the LED lighting devices 101~104 throughout the description and figures. $V_{IN1}$~$V_{INN}$ represent the voltages established across the $1^{st}$ to $N^{th}$ driving stages $ST_1$~$ST_N$, respectively. $V_{AK1}$~$V_{AKN}$ represent the voltages established across the corresponding first-type current controllers $CCA_1$~$CCA_N$, respectively. $V_{BK1}$~$V_{BKN}$ represent the voltages established across the corresponding second-type current controllers $CCB_1$~$CCB_N$, respectively. $V_{CK}$ represents the voltage established across the third-type current controller $CC_{N+1}$. $I_{AK1}$~$I_{AKN}$ represent the current flowing through the corresponding first-type current controllers $CCA_1$~$CCA_N$, respectively. $I_{BK1}$~$I_{BKN}$ represent the current flowing through the corresponding second-type current controllers $CCB_1$~$CCB_N$, respectively. $I_{A1}$~$I_{AN}$ represent the current flowing through the corresponding luminescent devices $A_1$~$A_N$, respectively. $I_{B1}$~$I_{BN}$ represent the current flowing through the corresponding luminescent devices $B_1$~$B_N$, respectively. $I_{D1}$~$I_{DN}$ represent the current flowing through the corresponding path controllers $D_1$~$D_N$, respectively. $I_{SUM1}$~$I_{SUMN}$ represent the current flowing through the corresponding driving stages $ST_1$~$ST_N$, respectively. The overall current of the LED lighting devices 101~104 may be represented by $I_{SUM(N+1)}$.

In the $1^{st}$ to $N^{th}$ driving stages $ST_1$~$ST_N$ of the LED lighting devices 101~103, the current detection and control units $UNA_1$~$UNA_N$, respectively coupled in series to the corresponding luminescent devices $A_1$~$A_N$ and the corresponding adjustable current sources $ISA_1$~$ISA_N$, are configured to regulate the values of the adjustable current sources $ISA_1$~$ISA_N$ according the current $I_{AK1}$~$I_{AKN}$, respectively. The voltage detection and control units $UNB_1$~$UNB_N$, respectively coupled in series to the corresponding luminescent devices $B_1$~$B_N$ and in parallel with the corresponding adjustable current sources $ISB_1$~$ISB_N$, are configured to regulate the values of the adjustable current sources $ISB_1$~$ISB_N$ according the voltages $V_{BK1}$~$V_{BKN}$ respectively.

In the $2^{nd}$ to $N^{th}$ driving stages $ST_2$~$ST_N$ of the LED lighting device 104, the current detection and control units $UNA_2$~$UNA_N$ respectively coupled in series to the corresponding luminescent devices $A_2$~$A_N$ and the corresponding adjustable current sources $ISA_2$~$ISA_N$, are configured to regulate the values of the adjustable current sources $ISA_2$~$ISA_N$ according the current $I_{AK2}$~$I_{AKN}$, respectively. The voltage detection and control units $UNB_2$~$UNB_N$, respectively coupled in series to the corresponding luminescent devices $B_2$~$B_N$ and in parallel with the corresponding adjustable current sources $ISB_2$~$ISB_N$, are configured to regulate the values of the adjustable current sources $ISB_2$~$ISB_N$ according the voltages $V_{BK2}$~$V_{BKN}$ respectively.

In the $(N+1)^{th}$ driving stage $ST_{N+1}$ of the LED lighting devices 101~104, the adjustable current source $IS_{N+1}$ is coupled in series to the $1^{st}$ to $N^{th}$ driving stages $ST_1$~$ST_N$. In a first configuration, the detection and control unit $UN_{N+1}$ of the third-type current controller $CC_{N+1}$ may be coupled in series to the adjustable current source $IS_{N+1}$ and is configured to regulate the value of the adjustable current source $IS_{N+1}$ according the current $I_{SUMN}$. In a second configuration, the detection and control unit $UN_{N+1}$ of the third-type current controller $CC_{N+1}$ may be coupled in parallel with the adjustable current source $IS_{N+1}$ and is configured to regulate the value of the adjustable current source $IS_{N+1}$ according the voltage $V_{CK}$. FIGS. 1~4 depict the embodiments adopting the first configuration, but do not limit the scope of the present invention.

In the embodiment of the present invention, each of the luminescent devices $A_1$~$A_N$ and $B_1$~$B_N$ may adopt a single LED or multiple LEDs coupled in series. FIGS. 1-4 depict the embodiments using multiple LEDs which may consist of single-junction LEDs, multi-junction high-voltage (HV) LEDs, or any combination of various types of LEDs. However, the types and configurations of the luminescent devices $A_1$~$A_N$ and $B_1$~$B_N$ do not limit the scope of the present invention. In a specific driving stage, the dropout voltage $V_{DROP}$ for turning on the corresponding current controller is smaller than the cut-in voltage $V_{CUT}$ for turning on the corresponding luminescent device. When the voltage established across a specific luminescent device exceeds its cut-in voltage $V_{CUT}$, the specific luminescent device may be placed in a conducting ON state; when the voltage established across the specific luminescent device does not exceed its cut-in voltage $V_{CUT}$, the specific luminescent device may be placed in a non-conducting OFF state. The value of the cut-in voltage $V_{CUT}$ is related to the number or type of the LEDs in the corresponding luminescent device and may vary in different applications.

In the embodiment of the present invention, each of the M charge storage units $CH_1$~$CH_M$ may adopt a capacitor, or one or multiple devices which provides similar function. However, the types and configurations of the charge storage units $CH_1$~$CH_M$ do not limit the scope of the present invention.

In the embodiment of the present invention, each of the path-controllers $D_1$~$D_N$ may adopt a diode, a diode-connected field effect transistor (FET), a diode-connected bipolar junction transistor (BJT) or other devices having similar function, or one or multiple devices which provides similar function. However, the types and configurations of the path controllers $D_1$~$D_N$ do not limit the scope of the present invention. When the voltage established across a specific path controller exceeds its turn-on voltage, the specific path controller is forward-biased and functions as a short-circuited device; when the voltage established across the specific path controller does not exceed its turn-on voltage, the specific path controller is reverse-biased and functions as an open-circuited device.

FIGS. 5~8 are diagrams illustrating the operation of the $1^{st}$ to $N^{th}$ driving stages $ST_1$~$ST_N$ in the LED lighting devices

Figure 5:
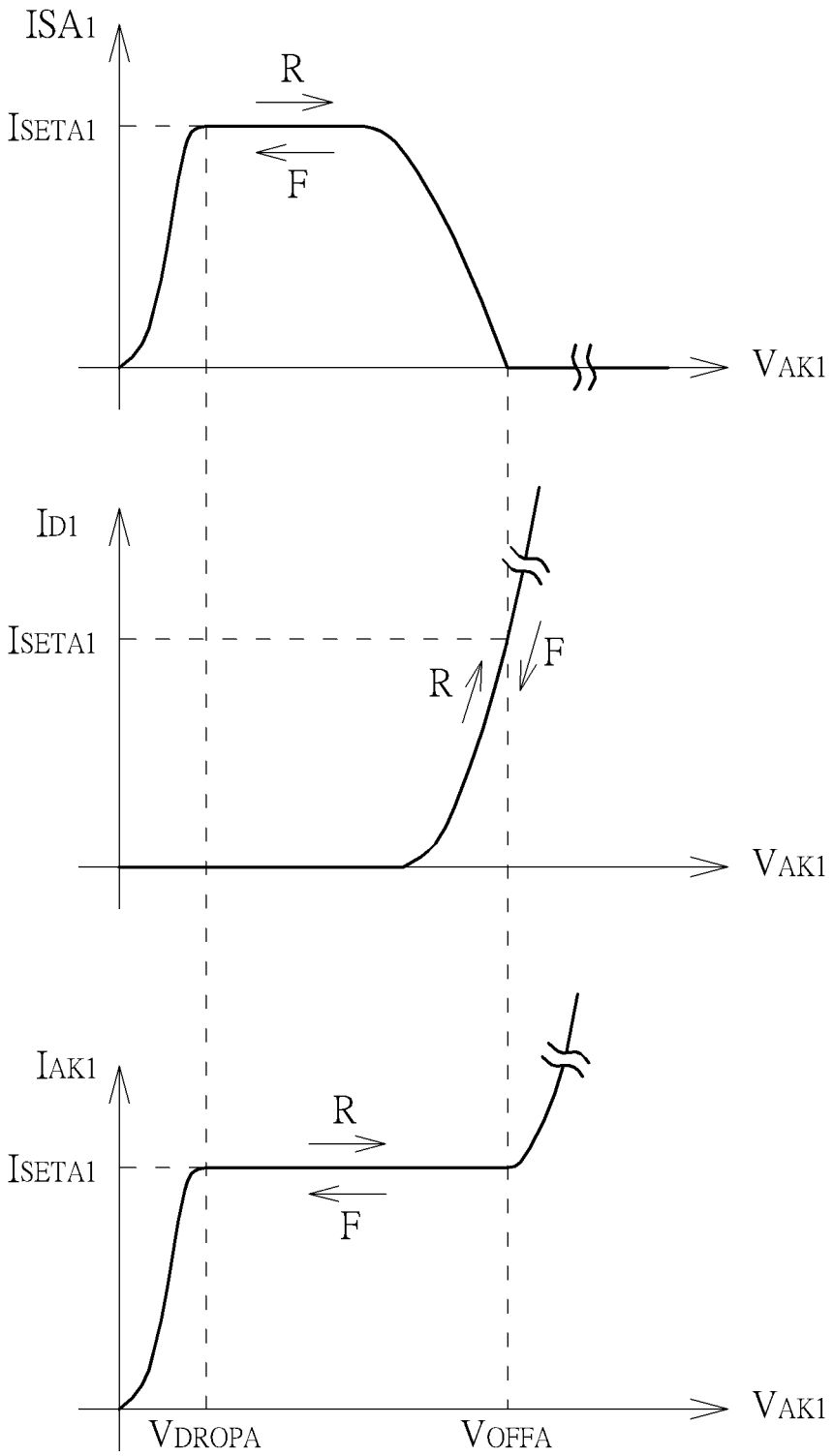
FIGS. 5~9 are diagrams illustrating the operation of the multiple driving stages in the LED lighting device of the present invention.
Figure 6:
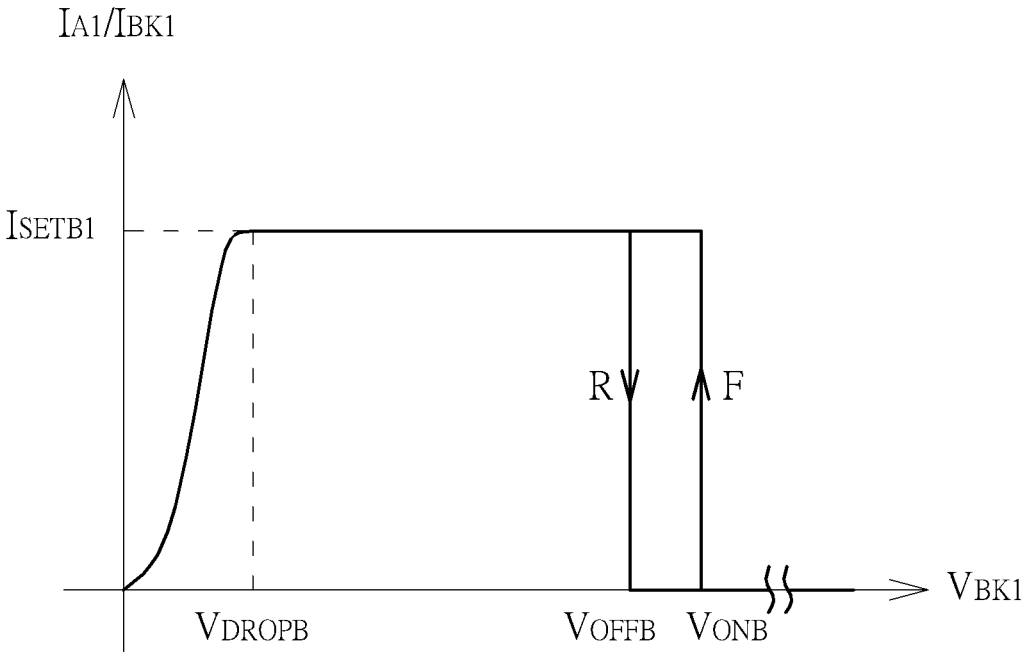
Figure 7:
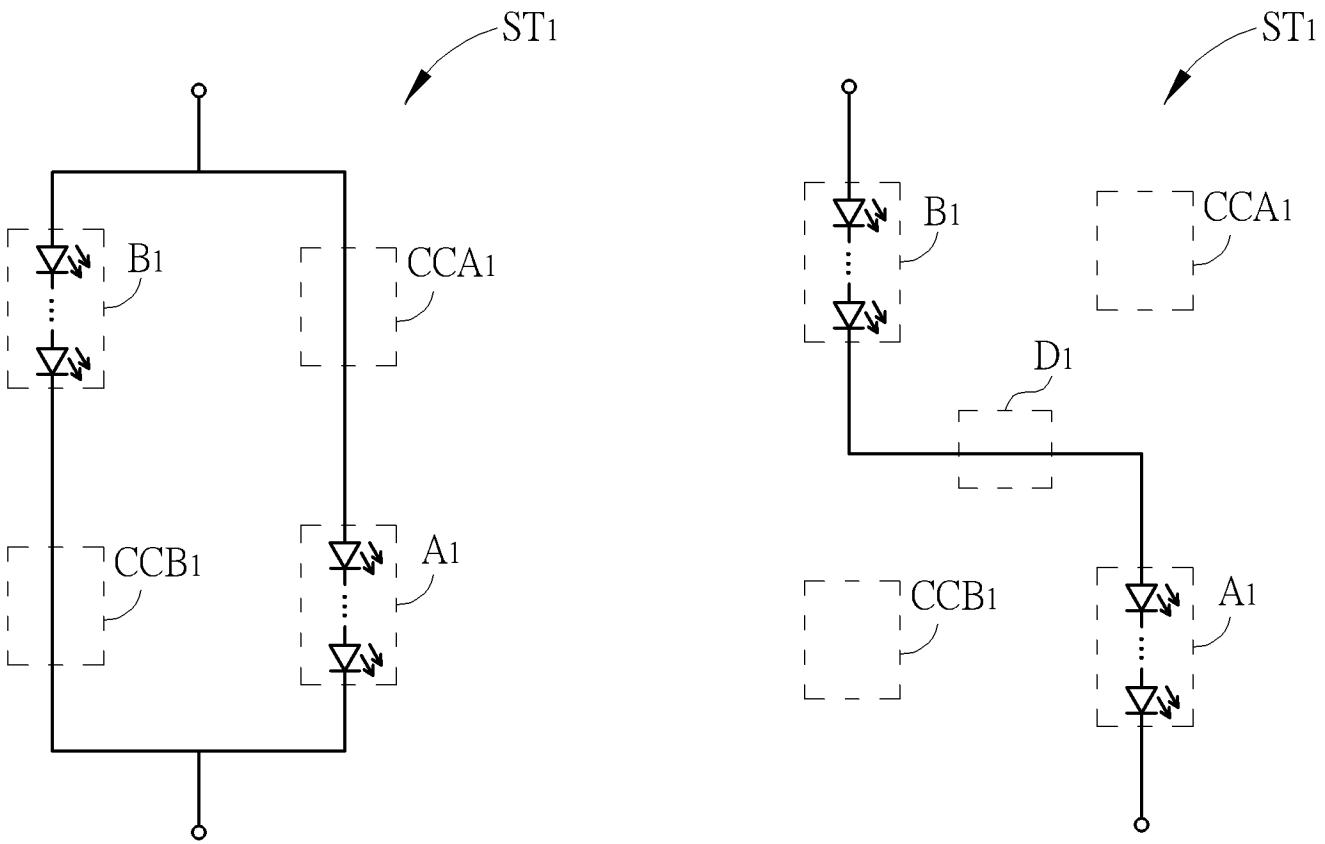
Figure 8:
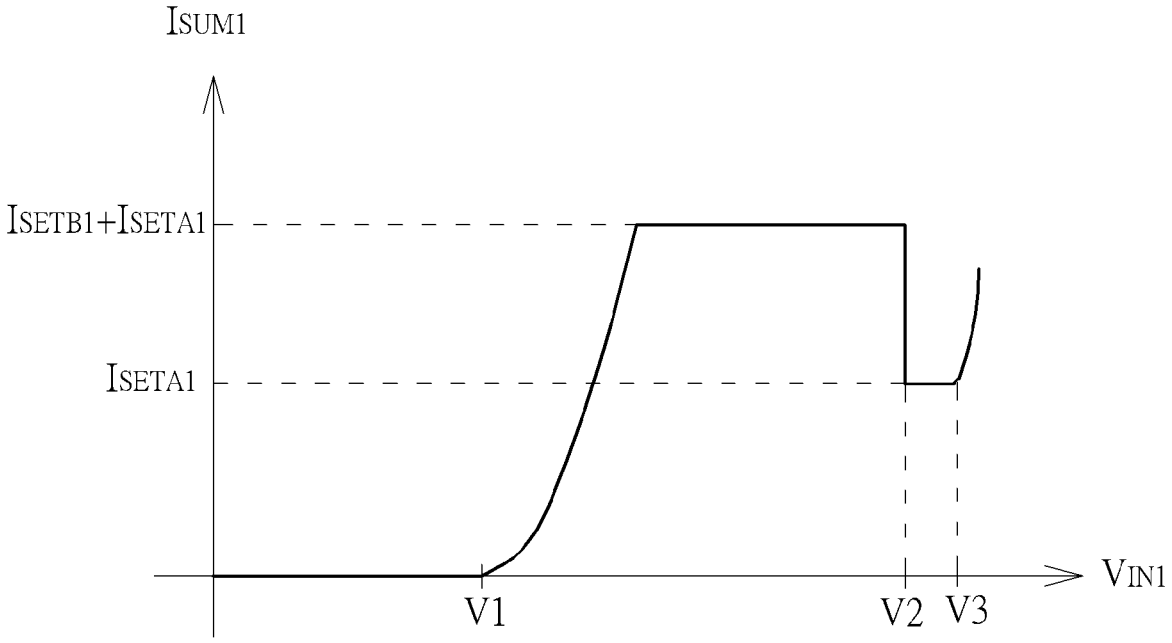
Figure 9:
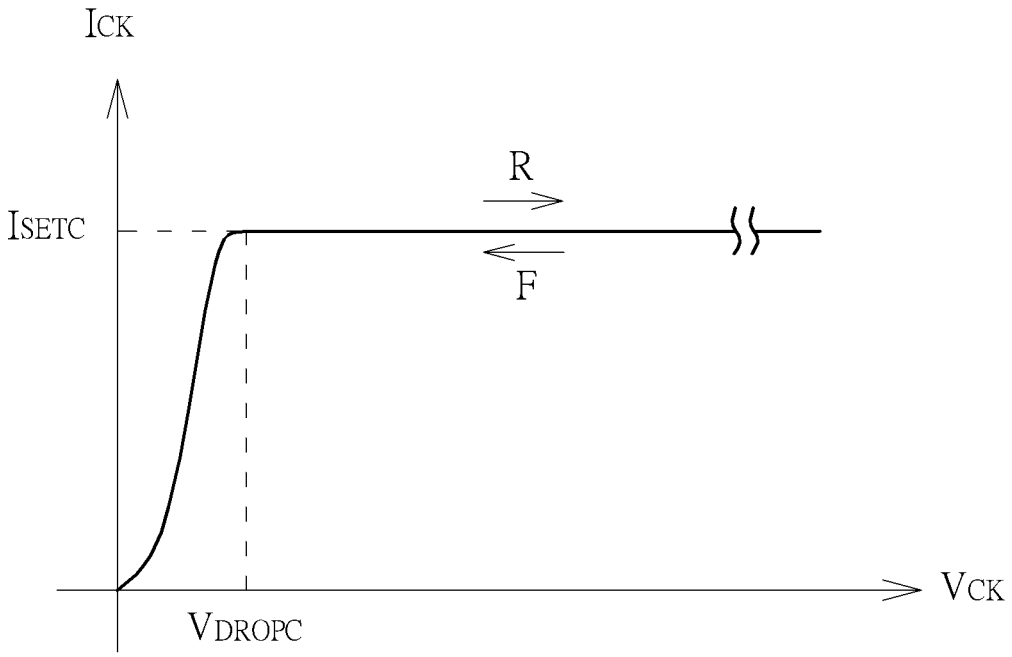

101-103 according to embodiments of the present invention. The driving stage $ST_1$ in the LED lighting devices 101-103 is used for illustrative purpose, wherein FIG. 5 illustrates the current-voltage curve (I-V curve) of the first-type current controller $CCA_1$, FIG. 6 illustrates the I-V curve of the second-type current controller $CCB_1$, FIG. 7 illustrates the equivalent circuits of the $1^{st}$ driving stage $ST_1$ during different phases of operation, and FIG. 8 illustrates the I-V curve of the $1^{st}$ driving stage $ST_1$. FIG. 9 is a diagram illustrating the operation of the current controller $CC_{N+1}$ in the $(N+1)^{th}$ driving stages $ST_{N+1}$ of the LED lighting devices 101-104. $V_{DROPA}$, $V_{DROPB}$ and $V_{DROPC}$ represent the drop-out voltages for turning on the first-type current controller $CCA_1$, the second-type current controller $CCB_1$ and the third-type current controller $CC_{N+1}$, respectively. $V_{OFFA}$, $V_{OFFB}$ and $V_{ONB}$ represent the threshold voltages based on which the first-type current controller $CCA_1$ or the second-type current controller $CCB_1$ switch operational modes. $I_{SETA1}$, $I_{SETB1}$ and $I_{SETC}$ are constant values which represent the current settings of the first-type current controller $CCA_1$, the second-type current controller and the third-type current controller $CC_{N+1}$, respectively. An arrow R indicates the rising period of the voltage $V_{AK1}$, $V_{BK1}$ or $V_{CK}$. An arrow L indicates the falling period of the voltage $V_{AK1}$, $V_{BK1}$ or $V_{CK}$.

In FIG. 5, during the rising and falling periods of the voltage $V_{AK1}$ when $0<V_{AK1}<V_{DROPA}$, the first-type current controller $CCA_1$ is not completely turned on and operates as a voltage-controlled device in a linear mode in which the current $I_{AK1}$ changes with the voltage $V_{AK1}$ in a specific manner. For example, if the first-type current controller $CCA_1$ is implemented using metal-oxide-semiconductor (MOS) transistors, the relationship between the current $I_{AK1}$ and the voltage $V_{AK1}$ may correspond to the I-V characteristic of an MOS transistor when operating in the linear region.

During the rising and falling periods of the voltage $V_{AK1}$ when $V_{AK1}>V_{DROPA}$, the current $I_{AK1}$ reaches $I_{SETA1}$, and the first-type current controller $CCA_1$ switches to a constant-current mode and functions as a current limiter. The current detection and control unit $UNA_1$ is configured to clamp the current $I_{AK1}$ at $I_{SETA1}$. For example, in response to an increase in the current $I_{D1}$, the current detection and control unit $UNA_1$ may decrease the value of the adjustable current source $ISA_1$ accordingly. Similarly, in response to a decrease in the current $I_{D1}$, the current detection and control unit $UNA_1$ may increase the value of the adjustable current source $ISA_1$ accordingly. Therefore, the current $I_{AK1}$ $(=I_{D1}+ISA_1)$ flowing through the $1^{st}$ driving stage $ST_1$ may be maintained at the constant value $I_{SETA1}$ instead of changing with the voltage $V_{AK1}$.

During the rising period of the voltage $V_{AK1}$ before the current $I_{D1}$ reaches $I_{SETA1}$, the current detection and control unit $UNA_1$ turns on the adjustable current source $ISA_1$ and the current controller $CCA_1$ functions as a current limiter in the constant-current mode in which the current $I_{AK1}$ $(=I_{SETA1}+I_{D1})$ is clamped at a constant value of $I_{SETA1}$. When the current $I_{D1}$ reaches $I_{SETA1}$, the current detection and control unit $UNA_1$ turns off the adjustable current source $ISA_1$ and the current controller $CCA_1$ switches to a cut-off mode in which the current $I_{AK1}$ increases with the current $I_{D1}$.

During the falling period of the voltage $V_{AK1}$ before the current $I_{D1}$ drops $I_{SETA1}$, the current detection and control unit $UNA_1$ turns off the adjustable current source $ISA_1$ and the current controller $CCA_1$ operates in the cut-off mode in which the current $I_{AK1}$ decreases with the current $I_{D1}$. When the current $I_{D1}$ drops to $I_{SETA1}$, the current detection and control unit $UNA_1$ turns on the adjustable current source $ISA_1$ and the current controller $CCA_1$ functions as a current limiter in the constant-current mode in which the current $I_{AK1}$ is clamped at a constant value of $I_{SETA1}$.

In FIG. 6, during the rising and falling periods of the voltage $V_{BK1}$ when $0<V_{BK1}<V_{DROPB}$, the second-type current controller $CCB_1$ is not completely turned on and operates as a voltage-controlled device in the linear mode in which the current $I_{BK1}$ changes with the voltage $V_{BK1}$ in a specific manner. For example, if the second-type current controller $CCB_1$ is implemented using MOS transistors, the relationship between the current $I_{BK1}$ and the voltage $V_{BK1}$ may correspond to the I-V characteristic of an MOS transistor when operating in the linear region.

During the rising period of the voltage $V_{BK1}$ when $V_{BK1}>V_{DROPB}$, the current $I_{BK1}$ reaches $I_{SETB1}$, and the current controller $CCB_1$ switches to the constant-current mode and functions as a current limiter. The voltage detection and control unit $UNB_1$ is configured to clamp the current $I_{BK1}$ at $I_{SETB1}$.

During the rising period of the voltage $V_{BK1}$ when $V_{BK1}>V_{OFFB}$, the voltage detection and control unit $UNB_1$ is configured to turn off the adjustable current source $ISB_1$ and the second-type current controller $CCB_1$ switches to the cut-off mode. In other words, the second-type current controller $CCB_1$ functions as an open-circuited device. During the falling period of the voltage $V_{BK1}$ when $V_{BK1}<V_{ONB}$, the voltage detection and control unit $UNB_1$ is configured to turn on the adjustable current source $ISB_1$ and the current controller $CCB_1$ switches to the constant-current mode and functions as a current limiter, thereby clamping the current $I_{BK1}$ at $I_{SETB1}$. The threshold voltage $V_{ONB}$ is larger than or equal to the threshold voltage $V_{OFFB}$. In an embodiment, a non-zero hysteresis band $(V_{ONB}-V_{OFFB})$ may be provided in order to prevent the second-type current controller $CCB_1$ from frequently switching operational modes due to fluctuations in the voltage $V_{BK1}$.

In FIG. 7, when the $1^{st}$ driving stage $ST_1$ operates in a first phase with $V\mathbf{1}<V_{IN1}<V\mathbf{2}$, the luminance device $A_1$ is coupled in parallel with the luminance device $B_1$, as depicted on the left of FIG. 7. When the $1^{st}$ driving stage $ST_1$ operates in a second phase with $V_{IN1}>V\mathbf{3}$, the luminance device $A_1$ is coupled in series to the luminance device $B_1$, as depicted on the right of FIG. 7.

In FIG. 8, during the rising period when the voltage $V_{IN1}$ is low, the luminance device $A_1$, the luminance device $B_1$ and the path-controller $D_1$ remain off. During the rising period as the voltage $V_{IN1}$ reaches a turn-on voltage $V_{A1}$ which is the sum of the cut-in voltage for turning on the luminance device $A_1$ and the cut-in voltage for turning on the first-type current controller $CCA_1$, the first-type current controller $CCA_1$ and the luminance device $A_1$ are turned on, allowing the current $I_{A1}$ to gradually increase with the voltage $V_{IN1}$ until reaching $I_{SETA1}$; during the rising period as the voltage $V_{IN1}$ reaches a turn-on voltage $V_{B1}$ which is the sum of the cut-in voltage for turning on the luminance device $B_1$ and the cut-in voltage for turning on the second-type current controller $CCB_1$, the second-type current controller $CCB_1$ and the luminance device $B_1$ are turned on, allowing the current $I_{B1}$ to gradually increase with the voltage $V_{IN1}$ until reaching $I_{SETB1}$. With the path controller D1 still off, the current $I_{SUM1}$ is equal to the sum of the current $I_{A1}$ and the current $I_{B1}$, wherein the current $I_{A1}$ is regulated by the current controllers $CCA_1$ and the current $I_{B1}$ is regulated by the current controllers $CCB_1$. The value of the turn-on voltage $V_{A1}$ may be equal to or different from that of the turn-on voltage $V_{B1}$. In other words, the current $I_{SUM1}$ starts to increase at a voltage V1 which is equal to the smaller one among the turn-on voltage $V_{A1}$ and the turn-on voltage $V_{B1}$.

During the rising period when the voltage $V_{IN1}$ reaches V2 so that $V_{BK1}=V_{OFFB}$, the second-type current controller $CCB_1$ switches to the cut-off mode in which the current $I_{B1}$ is directed towards the path-controller $D_1$, thereby turning on the path-controller D1. The current $I_{SUM1}$ is equal to the current $I_{B1}$ and $I_{A1}$, wherein both the current $I_{A1}$ and the current $I_{B1}$ are regulated by the first-type current controller $CCA_1$. As the current $I_{B1}$ flows through the path-controller $D_1$, the current $I_{D1}$ gradually increases with the voltage $V_{IN1}$. In response, the first-type current controller $CCA_1$ decreases the value of the adjustable current source $ISA_1$ accordingly, so that the overall current $I_{AK1}$ is still maintained at the constant value $I_{SETA1}$. When the value of the current source $ISA_1$ drops to zero at $V_{IN1}$=V3, the first-type current controller $CCA_1$ switches to the cut-off mode. The current $I_{SUM1}$ is now regulated by the subsequent driving stage.

In FIG. 9, during the rising and falling periods of the voltage $V_{CK}$ when $0<V_{CK}<V_{DROPC}$, the third-type current controller $CC_{N+1}$ is not completely turned on and operates as a voltage-controlled device in the linear mode in which the current $I_{CK}$ changes with the voltage $V_{CK}$ in a specific manner. For example, if the third-type current controller $CC_{N+1}$ is implemented using MOS transistors, the relationship between the current $I_{CK}$ and the voltage $V_{CK}$ may correspond to the I-V characteristic of an MOS transistor when operating in the linear region. During the rising and falling cycles of the voltage $V_{CK}$ when $V_{CK}>V_{DROPC}$, the current $I_{CK}$ reaches $I_{SETC}$, and the third-type current controller $CC_{N+1}$ switches to the constant-current mode and functions as a current limiter.

Similarly, the operation of the $2^{nd}$ to $N^{th}$ driving stages ST2~STN in the LED lighting device 104 may also be illustrated in FIGS. 5~8, while the operation of the current controller $CC_{N+1}$ in the (N+1)th driving stages $ST_{N+1}$ of the LED lighting device 104 may also be illustrated in FIG. 9.

In the present invention, the charge storage units $CH_1$~$CH_M$ may be coupled in parallel with one or multiple luminescent devices among the luminescent devices $A_1$~$A_N$ and $B_1$~$B_N$, respectively. The charge storage units $CH_1$~$CH_M$ can reduce the flicker of the LED lighting devices 101~104, wherein M may be smaller than or equal to 2N.

In an embodiment when M=2N, each of the luminescent devices $A_1$~$A_N$ and $B_1$~$B_N$ is coupled in parallel with a corresponding charge storage unit. For illustrative purpose, FIG. 1 depicts the above-mentioned embodiment of N=2 and M=4 in which the LED lighting device 101 includes 4 luminescent devices $A_1$~$A_2$ and $B_1$~$B_2$ coupled in parallel with the charge storage units $CH_1$~$CH_4$, respectively. However, the number and configuration of the charge storage units do not limit the scope of the present invention.

Figure 2:
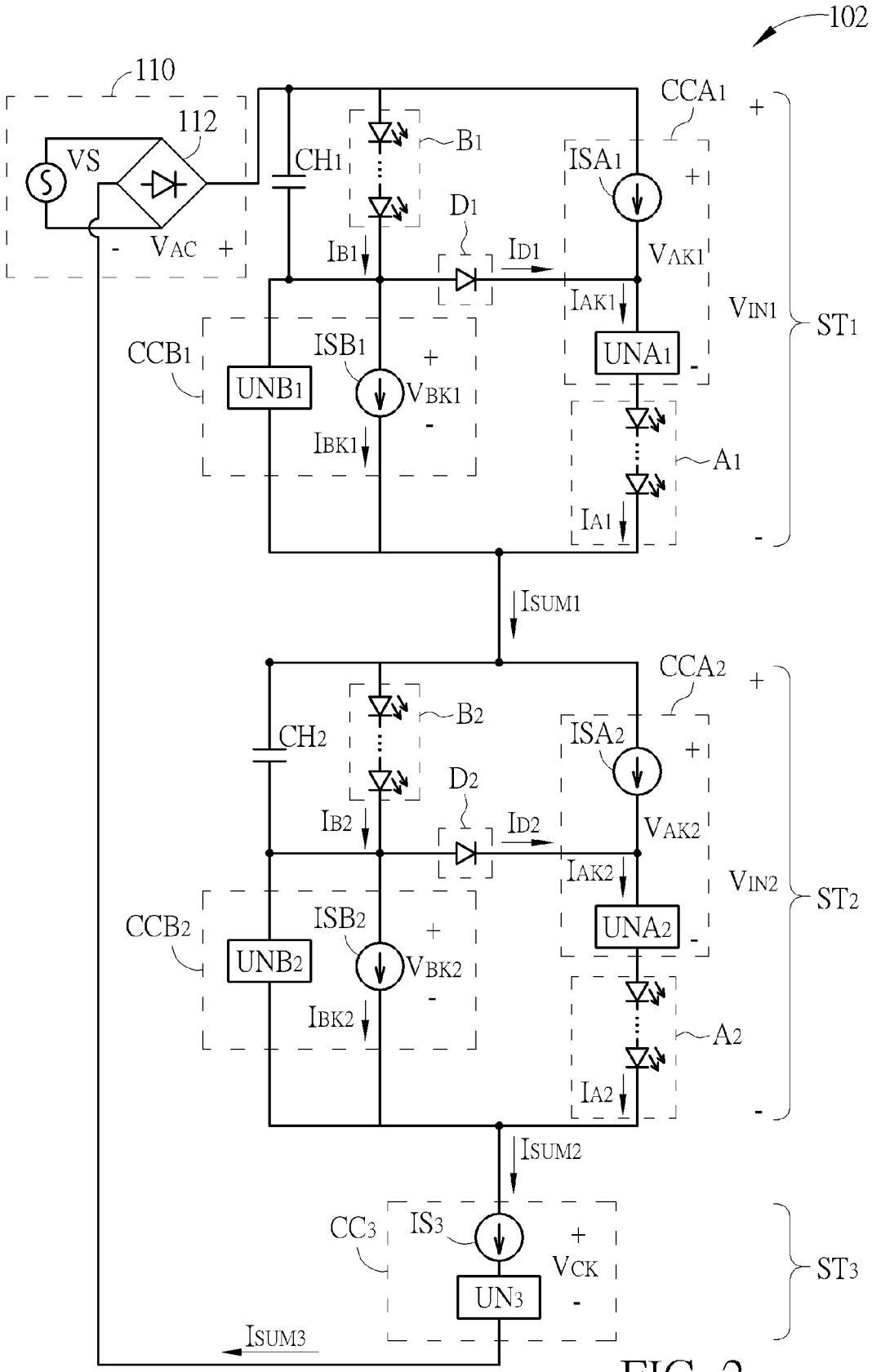

In an embodiment when M<2N, each of the luminescent devices $B_1$~$B_N$ is coupled in parallel with a corresponding charge storage unit. For illustrative purpose, FIG. 2 depicts the above-mentioned embodiment of N=2 and M=2 in which the LED lighting device 102 includes 4 luminescent devices $A_1$~$A_2$ and $B_1$~$B_2$ among which the luminescent devices $B_1$~$B_2$ are coupled in parallel with the charge storage units $CH_1$~$CH_2$, respectively. However, the number and configuration of the charge storage units do not limit the scope of the present invention.

Figure 3:
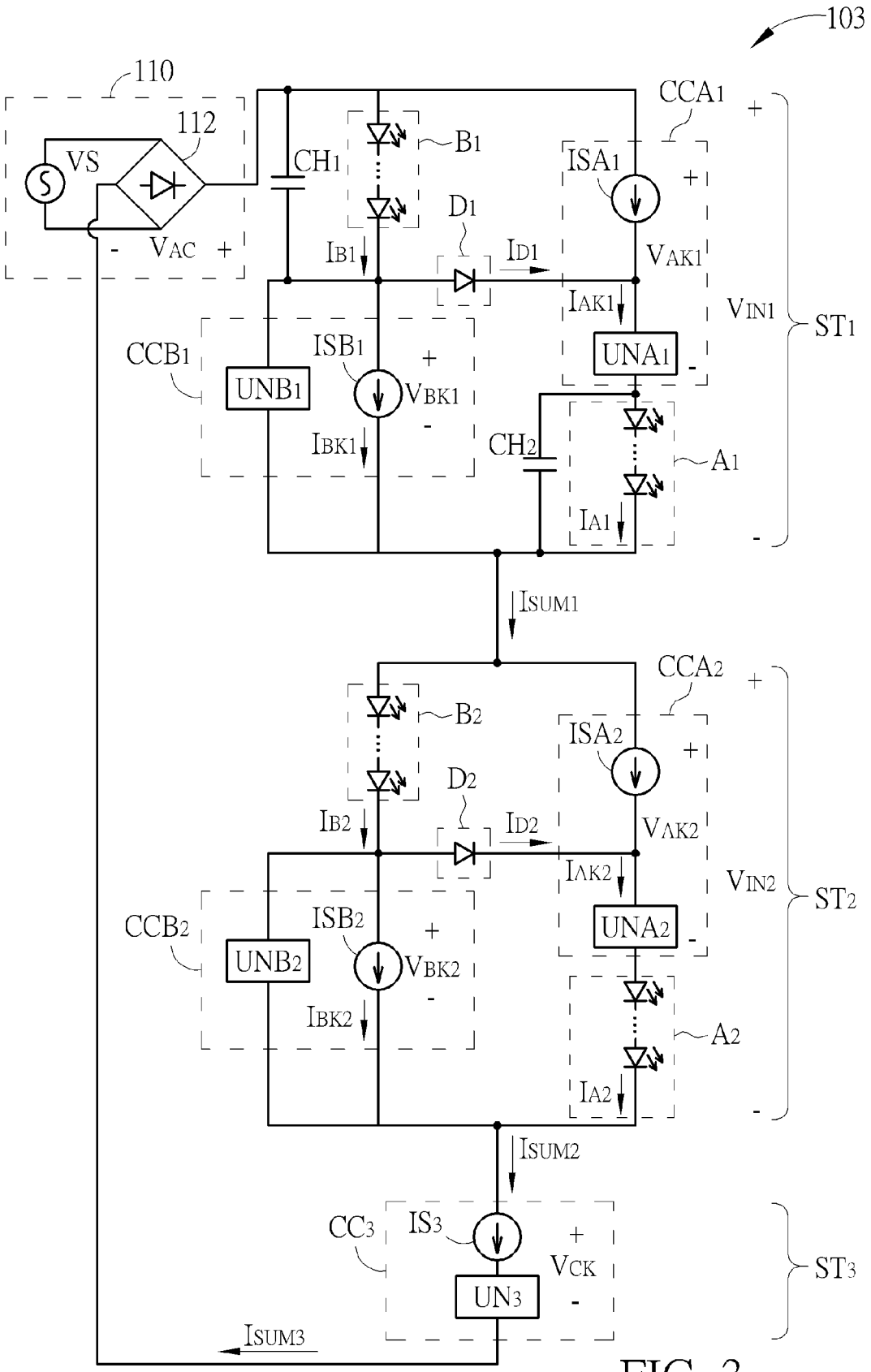

In an embodiment when M<2N, the M charge storage units $CH_1$~$CH_M$ may be coupled in parallel with the luminescent devices which have the longest turn-on time among the luminescent devices $A_1$~$A_N$ and $B_1$~$B_N$. For illustrative purpose, FIG. 3 depicts the above-mentioned embodiment of N=2 and M=2 in which the LED lighting device 103 includes 4 luminescent devices $A_1$~$A_2$ and $B_1$~$B_2$ among which the luminescent devices $A_1$ and $B_1$ are coupled in parallel with the charge storage units $CH_1$~$CH_2$, respectively. However, the number and configuration of the charge storage units do not limit the scope of the present invention.

Figure 4:
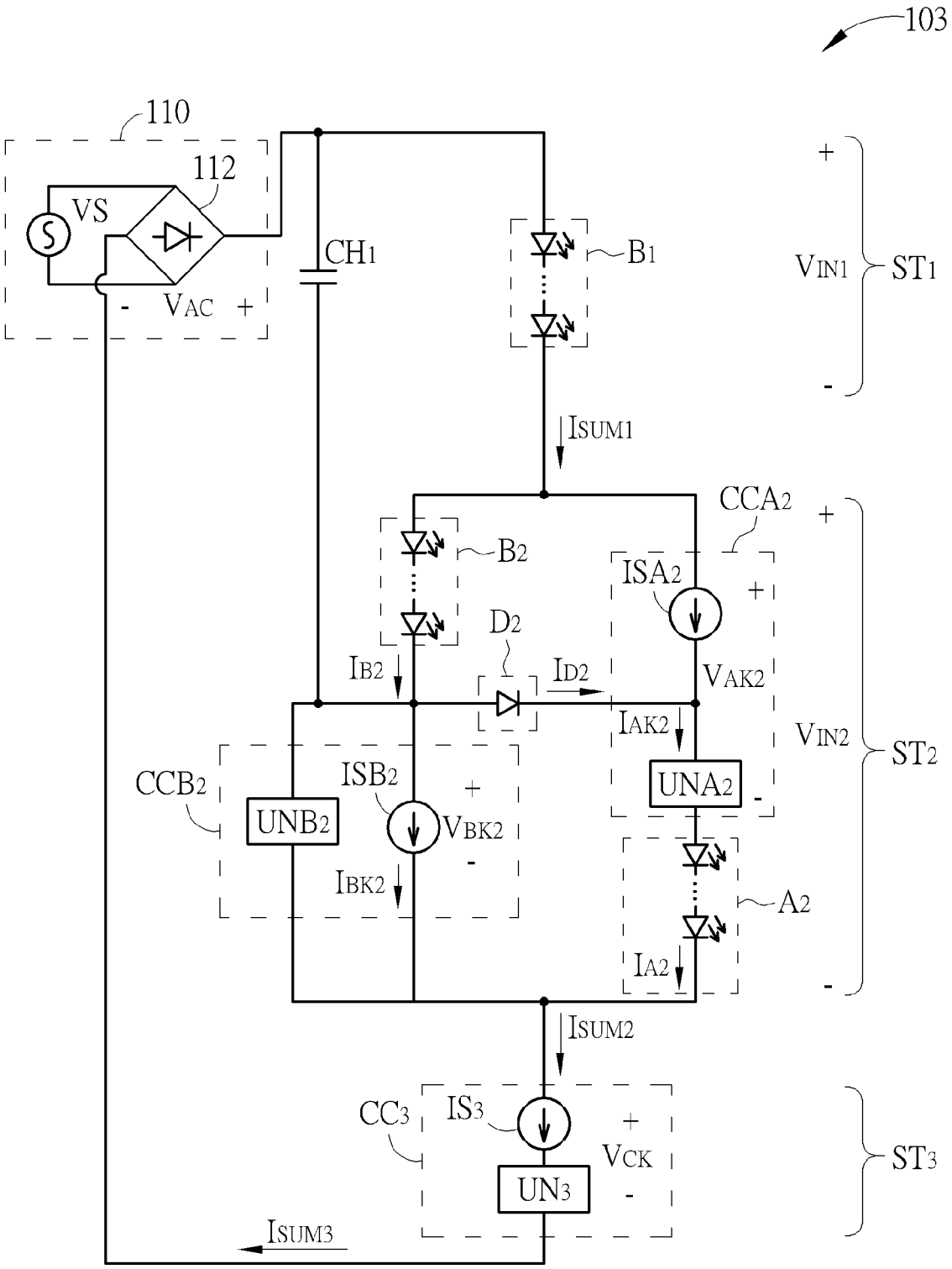

In an embodiment when M=1<2N, the charge storage unit $CH_1$ may be coupled in parallel with multiple luminescent devices which have the longest turn-on time among the luminescent devices $A_1$~$A_N$ and $B_1$~$B_N$. For illustrative purpose, FIG. 4 depicts the above-mentioned embodiment of N=2 and M=1 in which the LED lighting device 104 includes 3 luminescent devices $A_2$ and $B_1$~$B_2$ among which the luminescent devices $B_1$~$B_2$ are coupled in parallel with the charge storage unit $CH_1$. However, the number and configuration of the charge storage units do not limit the scope of the present invention.

Figure 10:
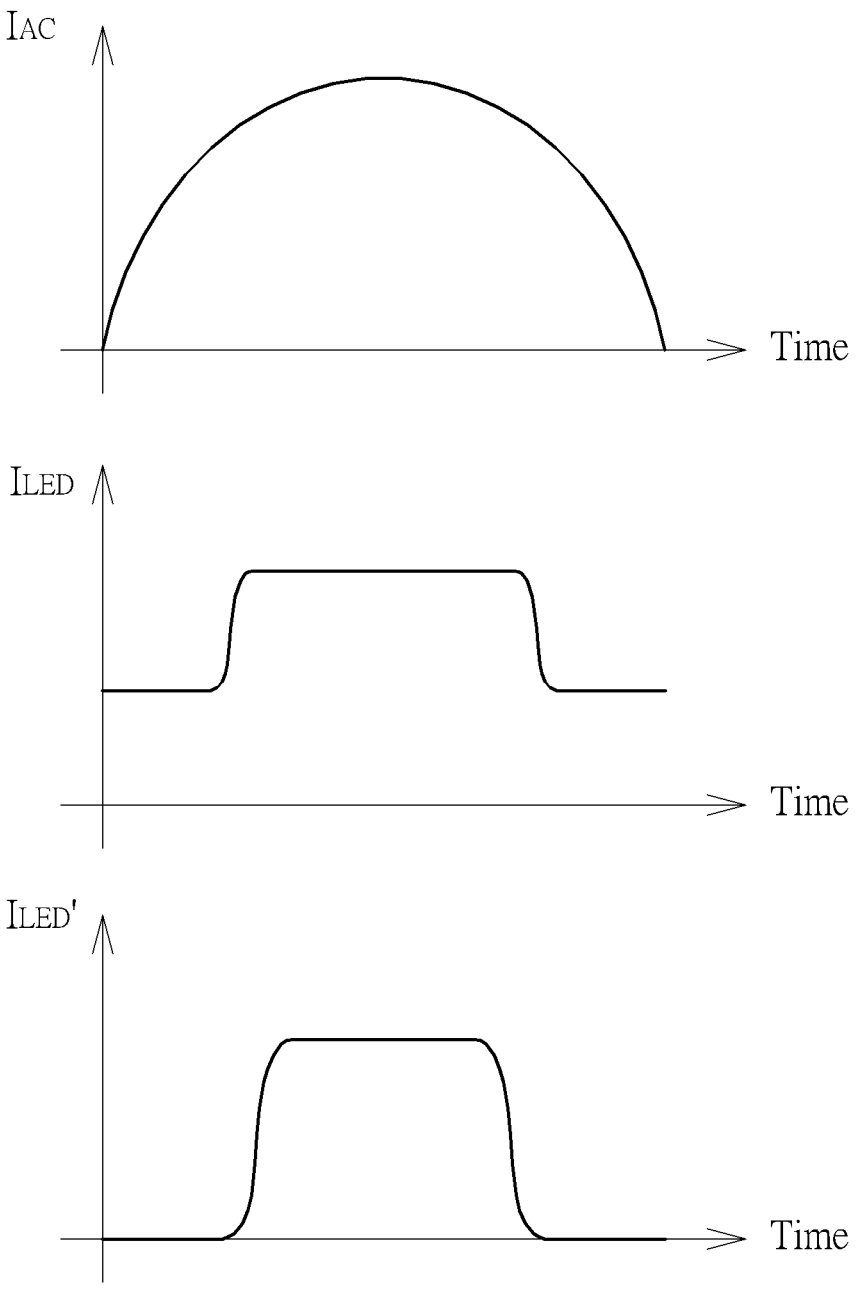
FIG. 10 is a diagram illustrating the current-time characteristic of the luminescent device in the LED lighting device of the present invention.

FIG. 10 is a diagram illustrating the current-time characteristic of the luminescent devices in the LED lighting devices 101~104. The diagram in the middle of FIG. 10 represents the current-time characteristic of a luminescent device adopting a first configuration, and the diagram at the bottom of FIG. 10 represents the current-time characteristic of a luminescent device adopting a second configuration. In FIG. 10, $I_{LED}$ represents the current flowing through the luminescent device adopting the first configuration and $I_{LED}$' represents the current flowing through the luminescent device adopting the second configuration. The luminescent device adopting the first configuration is coupled in parallel with a corresponding charge storage unit, such as the luminescent device $A_1$, $A_2$, $B_1$ or $B_2$ in the LED lighting device 101, the luminescent device $B_1$ or $B_2$ in the LED lighting device 102, the luminescent device $A_1$ or $B_1$ in the LED lighting device 103, or the luminescent device $B_1$ or $B_2$ in the LED lighting device 104. The luminescent device adopting the second configuration is not coupled in parallel with any charge storage unit, such as the luminescent device $A_1$ or $A_2$ in the LED lighting device 102, the luminescent device $A_2$ or $B_2$ in the LED lighting device 103, or the luminescent device $A_2$ in the LED lighting device 104.

During the rising period before the rectified AC voltage $V_{AC}$ becomes sufficiently large to turn on the luminescent device, the luminescent device adopting the second configuration remains in OFF state, while the luminescent device adopting the first configuration may be maintained in ON state by the energy discharged from the corresponding charge storage unit. The corresponding path controller is arranged to prevent the energy stored in the corresponding charge storage unit from being discharged through the corresponding current controller.

During the rising period or the falling period when the rectified AC voltage $V_{AC}$ becomes sufficiently large, the luminescent device adopting the first configuration or the luminescent device adopting the second configuration may be maintained in ON state by the rectified AC voltage $V_{AC}$, which is now charging the corresponding charge storage unit.

During the falling period after the rectified AC voltage $V_{AC}$ is no longer sufficiently large to turn on the luminescent device, the luminescent device adopting the second configuration remains in OFF state, while the luminescent device adopting the first configuration may still be maintained in ON state by the energy discharged from the corresponding charge storage unit. The corresponding path controller is arranged to prevent the energy stored in the corresponding charge storage unit from being discharged through the corresponding current control unit.

As depicted in FIG. 10, the introduction of the charge storage unit allows the luminescent device adopting the second configuration to have longer turn-on time than the luminescent device adopting the first configuration.

Figure 11:
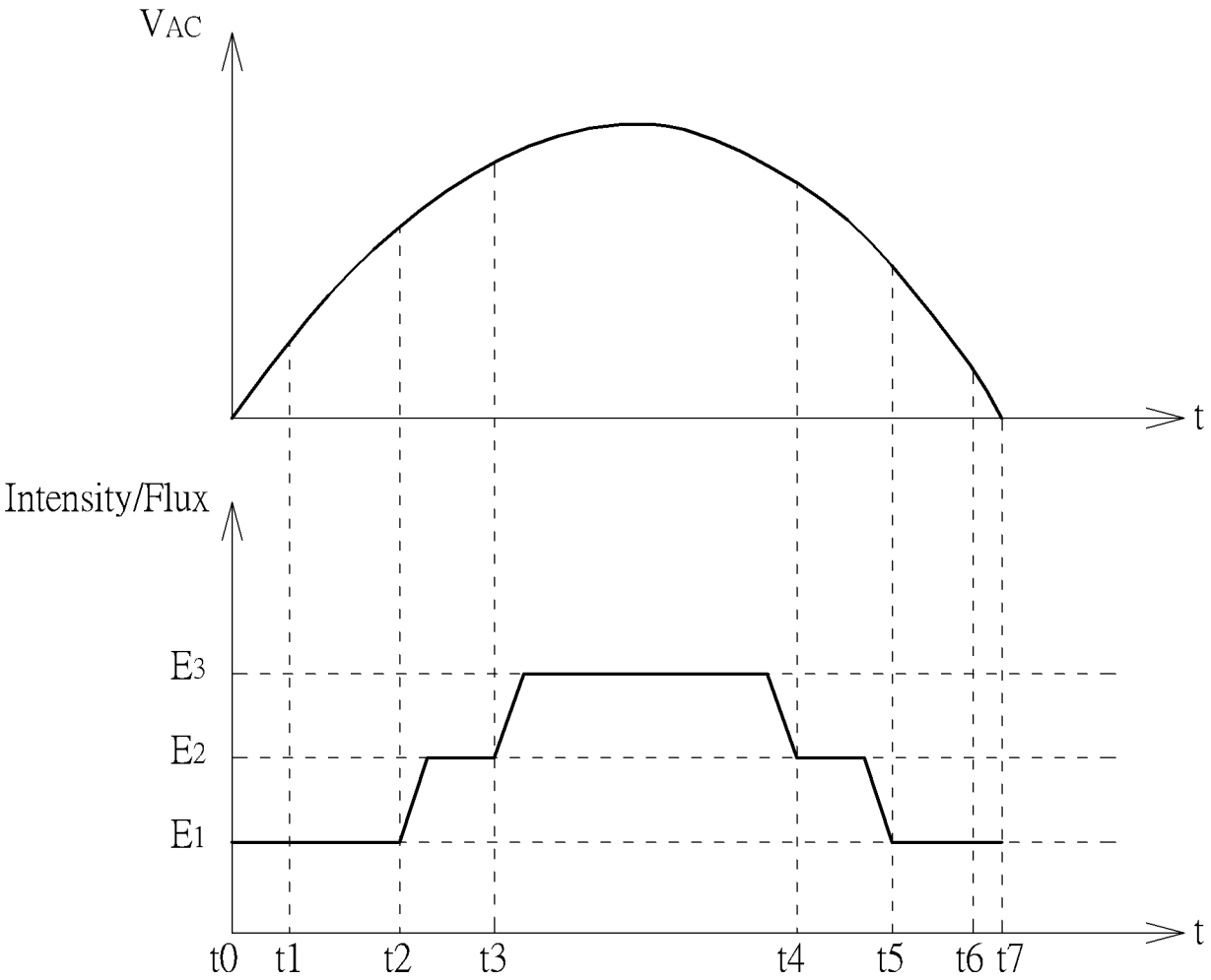
FIG. 11 is a diagram illustrating the overall operation of an LED lighting device according to embodiments of the present invention.
Figure 12:
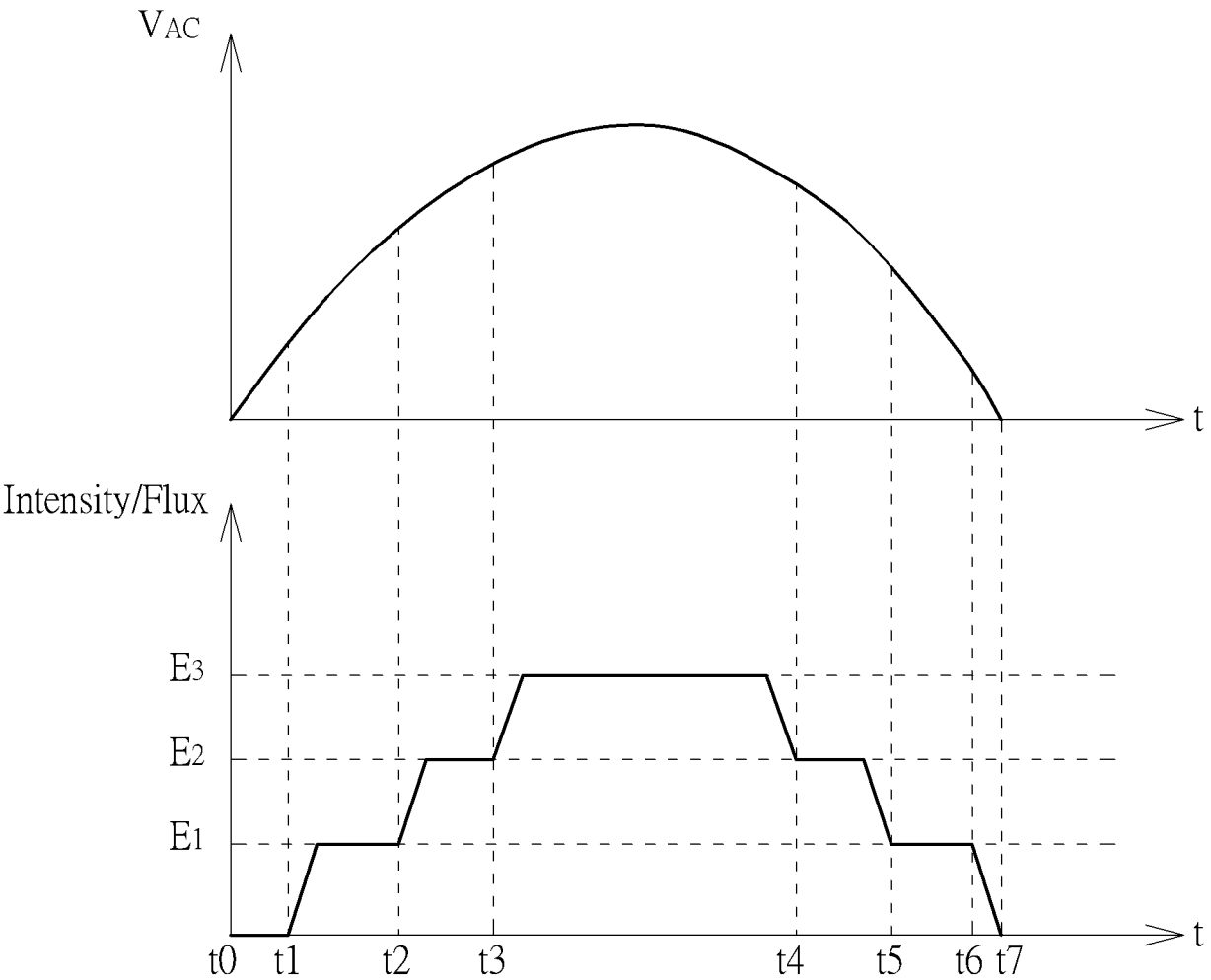
FIG. 12 is a diagram illustrating the overall operation of an LED lighting device.
Figure 13:
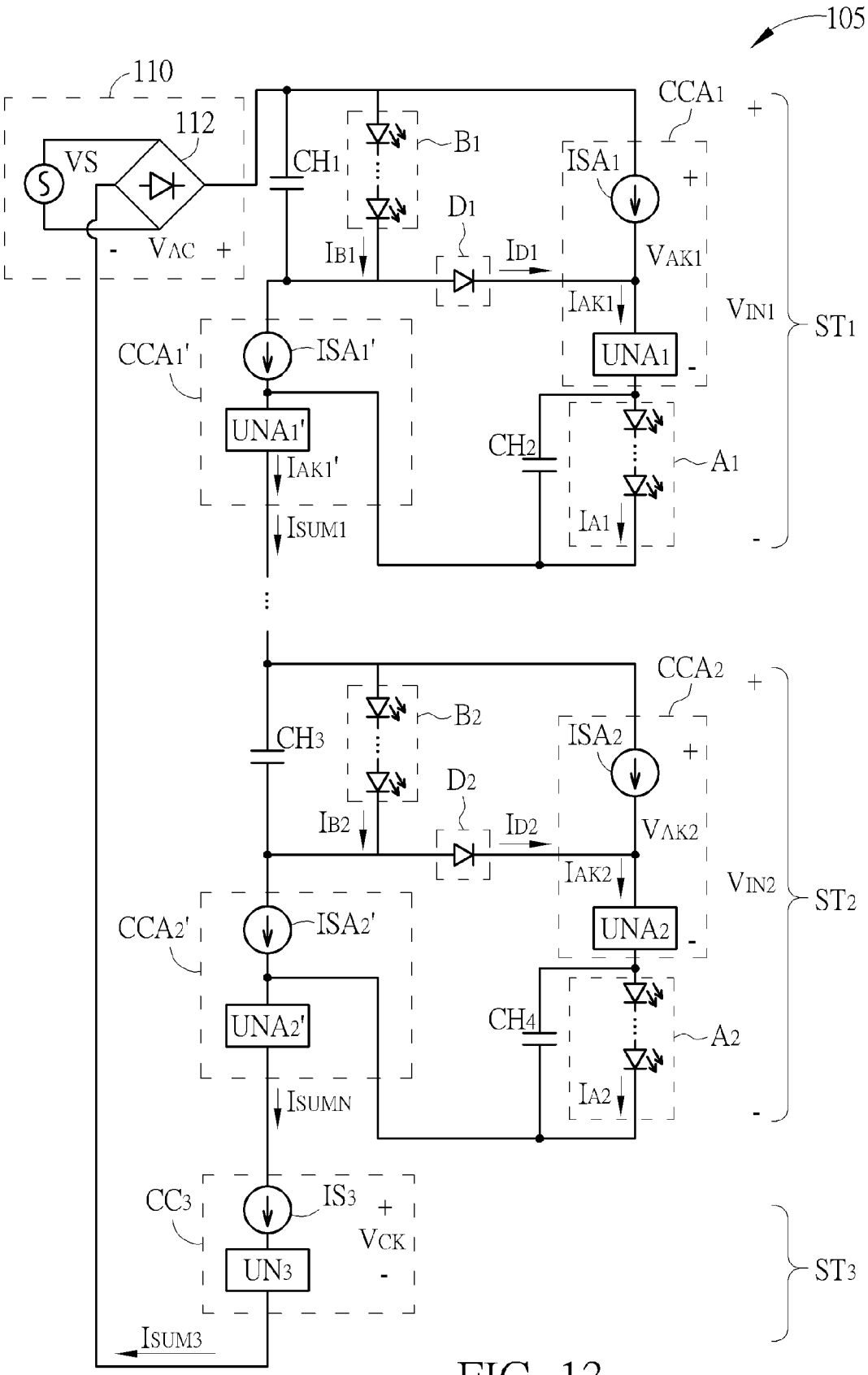
FIGS. 13~16 are diagrams of LED lighting devices according to other embodiments of the present invention.
Figure 14:
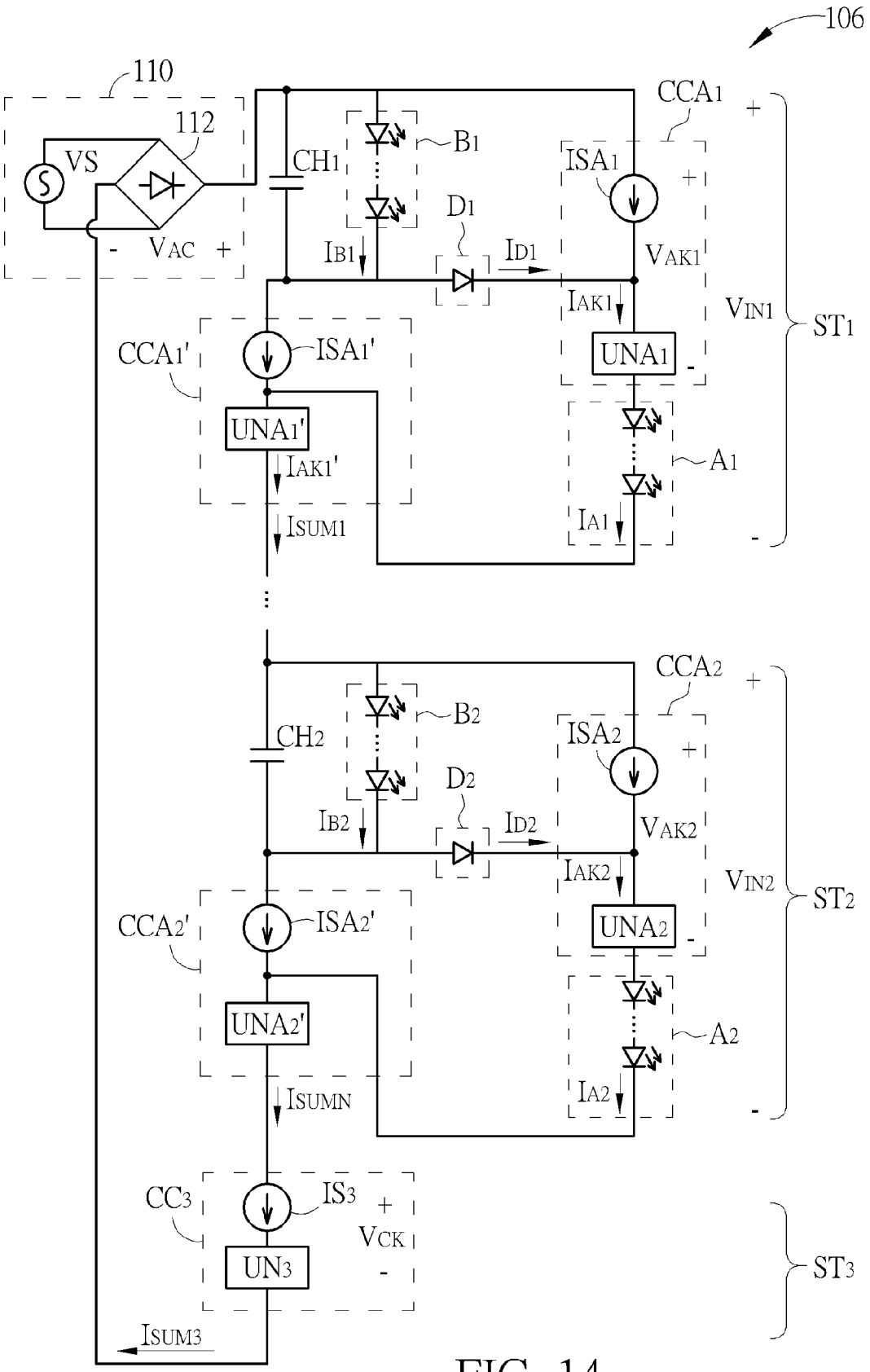
Figure 15:
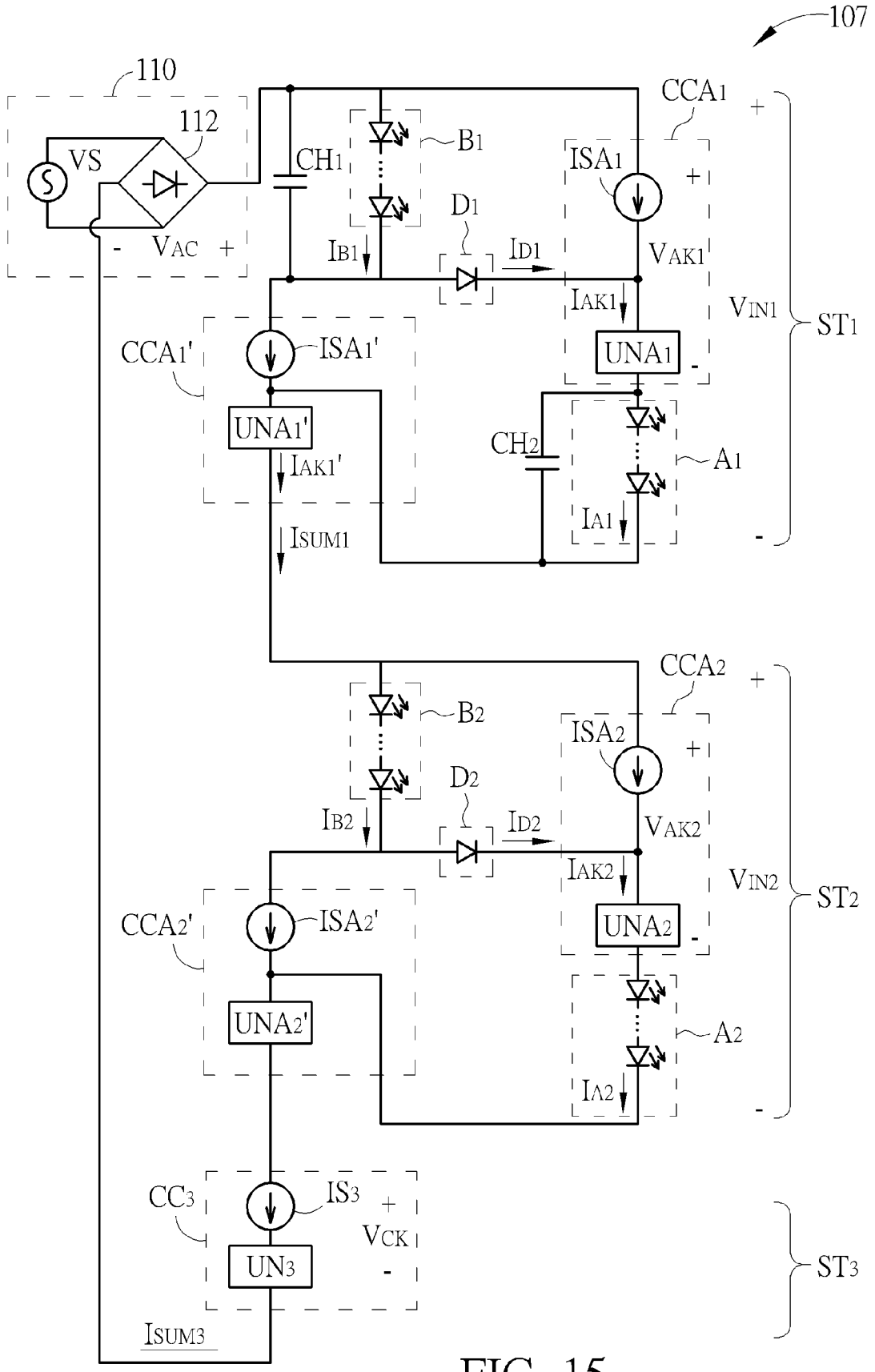
Figure 16:
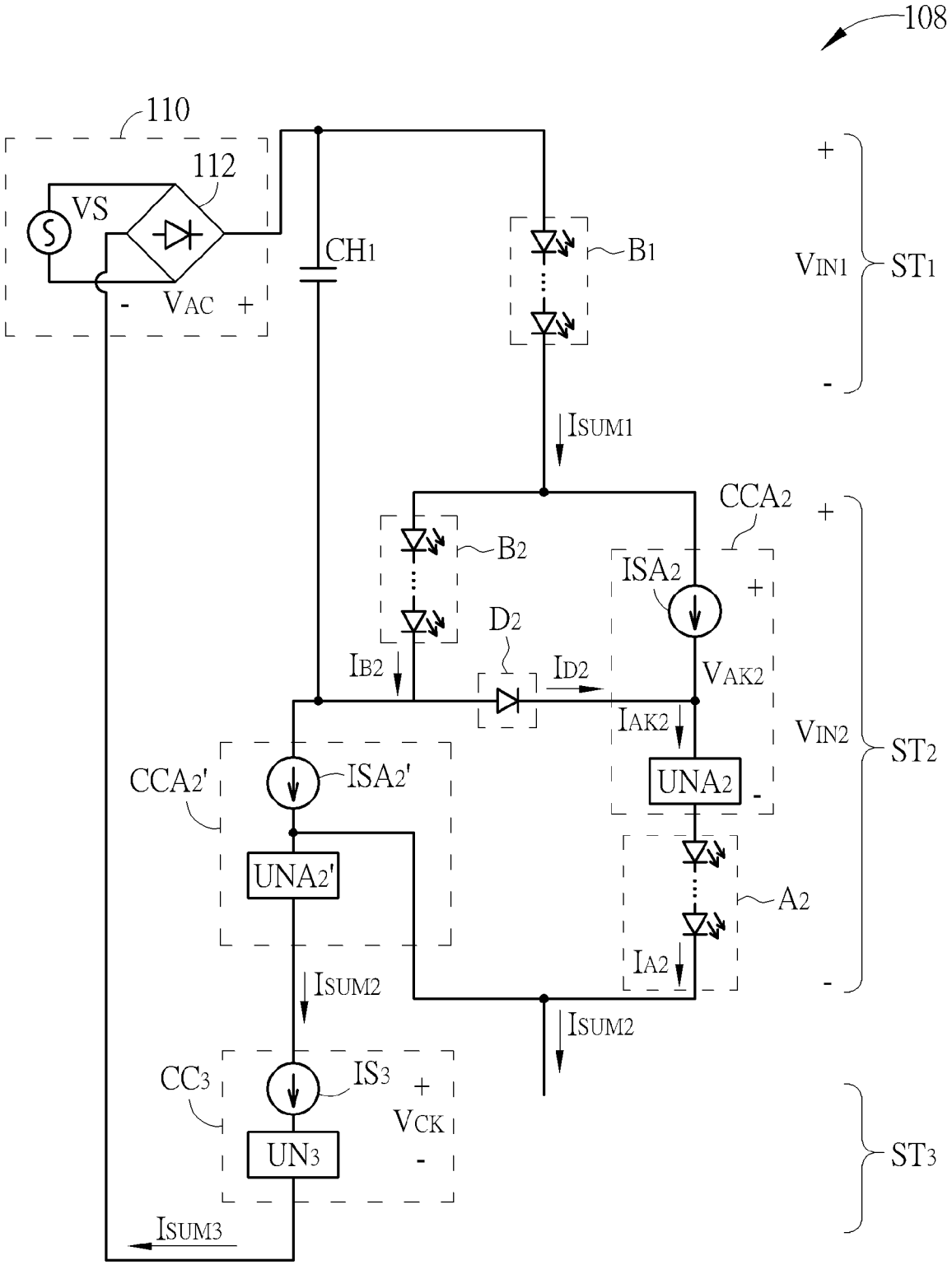

FIG. 11 is a diagram illustrating the overall operation of the LED lighting device 103 when two of the 4 luminescent devices $A_1$~$A_2$ and $B_1$~$B_2$ (N=2 and M=2) are coupled in parallel to respective charge storage units $CH_1$~$CH_2$ or coupled in parallel to one communal charge storage unit $CH_1$. FIG. 12 is a diagram illustrating the overall operation of the LED lighting device 103 when no charge storage unit is adopted. $E_1$~$E_3$ represent the overall intensity/flux of the present LED lighting device 103. It is to be noted that FIG. 12 is used as a comparison to FIG. 11 for illustrating how flicker can be improved using the present charge storage units as depicted in FIGS. 1~4, but is by no means an intended operation of present invention.

Since the voltages $V_{AK1}$~$V_{AK2}$ and $V_{BK1}$~$V_{BK2}$ are associated with the rectified AC voltage $V_{AC}$ whose value varies periodically with time, a driving cycle of $t_0$-$t_7$ is used for illustration, wherein the period between $t_0$-$t_3$ belongs to the rising period of the rectified AC voltage $V_{AC}$ and the period between $t_4$-$t_7$ belongs to the falling period of the rectified AC voltage $V_{AC}$. The following Table 1 lists the operational modes of the luminescent devices $A_1$~$A_2$ and $B_1$~$B_2$ in accordance with the configuration depicted in FIG. 11. The following Table 2 lists the operational modes of the luminescent devices $A_1$~$A_2$ and $B_1$~$B_2$ in accordance with the configuration depicted in FIG. 12.

TABLE 1

| luminescent device | t0~t1/ t6~t7 | t1~t2/ t5~t6 | t2~t3/ t4~t5 | t3~t4 |
|---|---|---|---|---|
| $A_1$ | ON (P) | ON (P) | ON (S) | ON (S) |
| $B_1$ | ON (P) | ON (P) | ON (S) | ON (S) |
| $A_2$ | OFF | ON (P) | ON (P) | ON (S) |
| $B_2$ | OFF | ON (P) | ON (P) | ON (S) |

TABLE 2

| luminescent device | t0~t1/ t6~t7 | t1~t2/ t5~t6 | t2~t3/ t4~t5 | t3~t4 |
|---|---|---|---|---|
| $A_1$ | OFF | ON (P) | ON (S) | ON (S) |
| $B_1$ | OFF | ON (P) | ON (S) | ON (S) |
| $A_2$ | OFF | ON (P) | ON (P) | ON (S) |
| $B_2$ | OFF | ON (P) | ON (P) | ON (S) |

In FIG. 12 and Table 2, at the beginning of the rising period and at the end of the falling period, the rectified AC voltage $V_{AC}$ is insufficient to turn on the luminescent devices $A_1$~$A_2$ and $B_1$~$B_2$. Without the present charge storage units, the luminescent devices $A_1$~$A_2$ and $B_1$~$B_2$ remain in the OFF state between t0~t1 and t6~t7. Between t1~t6, the luminescent devices $A_1$~$A_2$ and $B_1$~$B_2$ are sequentially turned on as the rectified AC voltage $V_{AC}$ increases or decreases, and the $1^{st}$ driving stage $ST_1$ and the $2^{nd}$ driving stage $ST_1$ may operates in the first phase in which the two turned-on luminance devices are coupled in parallel (designated by "P" in Table 1 and Table 2) as depicted on the left of FIG. 7 or in the second phase in which the two turned-on luminance devices are coupled in series (designated by "S" in Table 1 and Table 2) as depicted on the right of FIG. 7. More specifically, the overall intensity/flux of the LED lighting device 103 varies stepwise and reaches $E_3$ between t3~t4 when all the luminescent devices $A_1$~$A_2$ and $B_1$~$B_2$ operate in the ON state in the series configuration.

In FIG. 11 and Table 1, at the beginning of the rising period and at the end of the falling period, the rectified AC voltage $V_{AC}$ is insufficient to turn on the luminescent devices $A_1$~$A_2$ and $B_1$~$B_2$. With the present charge storage units, the luminescent devices $A_1$ and $B_1$ may be kept in the ON state during the entire driving period between t0~t7 regardless of the rectified AC voltage $V_{AC}$. More specifically, the overall intensity/flux of the present LED lighting device 103 may be maintained at $E_1$ between t0~t1 and t6~t7 when the rectified AC voltage $V_{AC}$ is still small.

As well-known to those skilled in the art, LED flicker is periodic, with its waveforms characterized by variations in amplitude, average level, periodic frequency, shape, and/or duty cycle. Percent Flicker and Flicker Index are metrics historically used to quantify flicker, as represented by the following formula:

$$\text{Percent Flicker} = 100\% \times \frac{\text{MAX} - \text{MIN}}{\text{MAX} + \text{MIN}} \quad (1)$$

$$\text{Flicker Index} = \frac{\text{AREA1}}{\text{AREA1} + \text{AREA2}} \quad (2)$$

In formula (1), MAX represents the maximum intensity/flux of the LED lighting devices 101~104, while MIN represents the minimum intensity/flux of the LED lighting devices 101~104. In formula (2), AREA1 represents the summation of intensity/flux within a duration of a driving cycle when the intensity/flux of the LED lighting devices 101~104 is above its average, while AREA2 represents the summation of intensity/flux within a duration of the driving cycle when the intensity/flux of the LED lighting devices 101~104 is below its average.

As can be seen in FIG. 11, the introduction of the charge storage units can increase MIN in formula (1) and AREA2 in formula (2), thereby lowering the Percent Flicker and Flicker Index of the LED lighting devices 101~104.

FIGS. 13~16 are diagram of LED lighting devices 105~108 according to other embodiments of the present invention. Similar to the LED lighting devices 101~104 depicted in FIGS. 1~4, each of the LED lighting devices 105~108 also includes a power supply circuit 110 and (N+1) driving stages $ST_1$~$ST_{N+1}$ (N is a positive integer). However, the LED lighting devices 105~107 differ from the LED lighting devices 101~103 in that each of the $1^{st}$ to $N^{th}$ driving stages $ST_1$~$ST_N$ includes a plurality of luminescent devices, a path controller, and two first-type current controllers. The LED lighting device 108 differs from the LED lighting device 104 in that each of the $2^{nd}$ to $N^{th}$ driving stages $ST_2$~$ST_N$ includes a plurality of luminescent devices, a path controller, and two first-type current controllers.

Each first-type current controller in the LED lighting devices 105~108 includes an adjustable current source and a current detection and control unit, and its I-V curve may also be shown in FIG. 5. In the first-type current controllers represented by $CCA_1$~$CCA_N$, the current detection and control units $UNA_1$~$UNA_N$, respectively coupled in series to the corresponding luminescent devices $A_1$~$A_N$ and the corresponding adjustable current sources $ISA_1$~$ISA_N$, are configured to regulate the values of the adjustable current sources $ISA_1$~$ISA_N$ according the current $I_{AK1}$~$I_{AKN}$, respectively. In the first-type current controller represented by $CCA_{1'}$~$CCA_{N'}$, the current detection and control units $UNA_{1'}$~$UNA_{N'}$, respectively coupled in series to the corresponding luminescent devices $B_1$~$B_N$ and the corresponding adjustable current sources $ISA_{1'}$~$ISA_{N'}$, are configured to regulate the values of the adjustable current sources $ISA_1$~$ISA_N$, according the current $I_{BK1}$~$I_{BKN}$, respectively.

With the above-mentioned multi-stage driving scheme, the present invention may turn on multiple luminescent devices flexibly using multiple current control units. With the above-mentioned charge storage units, the present invention may reduce luminous variation of the LED lighting device. Therefore, the present invention can provide an LED lighting device capable of improving the effective operational voltage range, the reliability and the flicker phenomenon.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light-emitting diode (LED) lighting device having multiple driving stages, comprising:

a first driving stage including:

a first luminescent device driven by a rectified alternative-current (AC) voltage for providing light according to first current;

a second luminescent device driven by the rectified AC voltage for providing light according to second current;

a first current controller coupled in series to the first luminescent device and configured to regulate the first current so that the first current does not exceed a first value;

a second current controller coupled in series to the second luminescent device and configured to regulate the second current so that the second current does not exceed a second value;

a first charge storage unit coupled in parallel with at least the first luminescent device and configured to discharge energy to the first luminescent device when the rectified AC voltage is insufficient to turn on the first luminescent device, thereby keeping the first luminescent device turned on; and a first path-controller configured to conduct third current and comprising:

a first end coupled between the first luminescent device and the first current controller; and a second end coupled to the second current controller; and a second driving stage including:

a third current controller coupled in series to the first driving stage and configured to conduct fourth current and regulate the fourth current so that the fourth current does not exceed a third value.

2. The LED lighting device of claim 1, wherein the first charge storage unit is further configured to stop discharging the energy to the first luminescent device and start to be charged by the rectified AC voltage when the rectified AC voltage become sufficient to turn on the first luminescent device.

3. The LED lighting device of claim 1, further comprising:

a second charge storage unit coupled in parallel with the second luminescent device and configured to discharge energy to the second luminescent device when the rectified AC voltage is insufficient to turn on the second luminescent device, thereby keeping the second luminescent device turned on.

4. The LED lighting device of claim 1, further comprising:

a third driving stage coupled between the rectified AC voltage and the first driving stage and including:

a third luminescent device driven by the rectified AC voltage for providing light, wherein the first charge storage unit is coupled in parallel with the first luminescent device and the third luminescent device and configured to discharge energy to the first luminescent device and the third luminescent device when the rectified AC voltage is insufficient to turn on the first luminescent device and the third luminescent device, thereby keeping the first luminescent device and the third luminescent device turned on.

5. The LED lighting device of claim 4, wherein the first charge storage unit is further configured to stop discharging the energy to the first luminescent device and the third luminescent device and start to be charged by the rectified AC voltage when the rectified AC voltage become sufficient to turn on the first luminescent device and the third luminescent device.

6. The LED lighting device of claim 1, wherein:

during a rising period or a falling period of a rectified AC voltage when a voltage established across the first current controller does not exceed a first voltage, the first current controller operates in a first mode in which the first current changes with the voltage established across the first current controller;

during the rising period when the voltage established across the first current controller exceeds the first voltage but does not exceed a second voltage, the first current controller operates in a second mode in which the first current is maintained at the first value; and during the rising period when the voltage established across the first current controller exceeds the second voltage, the first current controller operates in a third mode in which the first current controller is turned off.

7. The LED lighting device of claim 6, wherein:

during the falling period when the voltage established across the first current controller exceeds the second voltage but does not exceed a third voltage, the first current controller operates in the second mode in which the first current is maintained at the first value, and the third voltage is larger than or equal to the second voltage.

8. The LED lighting device of claim 1, wherein:

during a rising period or a falling period of the rectified AC voltage when the voltage established across the second current controller does not exceed a fourth voltage, the second current controller operates in a first mode in which the second current changes with the voltage established across the second current controller;

during the rising period or the falling period when the third current does not exceed the second value, the second current controller operates in a second mode in which the second current is maintained at the second value; and during the rising period or the falling period when the third current exceeds the second value, the second current controller operates in a third mode in which the second current controller is turned off.

9. The LED lighting device of claim 1, wherein:

during a rising period or a falling period of the rectified AC voltage when the voltage established across the third current controller does not exceed a sixth voltage, the third current controller operates in a first mode in which the fourth current changes with the voltage established across the third current controller; and during the rising period or the falling period when the voltage established across the third current controller exceeds the sixth voltage, the third current controller operates in a second mode in which the fourth current is maintained at the third value.

10. The LED lighting device of claim 1, wherein the first current controller includes:

a first adjustable current source configured to conduct fifth current; and a first detection and control unit coupled in parallel with the first adjustable current and configured adjust the fifth current according to a voltage established across the first current controller.

11. The LED lighting device of claim 1, wherein the first current controller includes:

a first adjustable current source configured to conduct fifth current, and comprising:

a first end coupled to the first luminescent device; and a second end coupled to the second luminescent device; and a first detection and control unit coupled in series to the first adjustable current source and configured adjust the fifth current according to the first current and the second current.

12. The LED lighting device of claim 1, wherein the second current controller includes:

a second adjustable current source configured to conduct sixth current; and a second detection and control unit configured adjust the sixth current according to the second current or the third current, and comprising:

a first end coupled to the second end of the first path-controller and the second adjustable current source; and a second end coupled to the second luminescent device.

13. The LED lighting device of claim 1, wherein:

the first current controller includes:

a first adjustable current source configured to conduct fifth current; and a first detection and control unit coupled in parallel with the first adjustable current source and configured adjust the fifth current according to a voltage established across the first current controller; and the second current controller includes:

a second adjustable current source configured to conduct sixth current; and a second detection and control unit configured adjust the sixth current according to the second current or the third current, and comprising:

a first end coupled to the second end of the first path-controller and the second adjustable current source; and a second end coupled to the second luminescent device.

14. The LED lighting device of claim 1, wherein:

the first current controller includes:

a first adjustable current source configured to conduct fifth current, and comprising:

a first end coupled to the first luminescent device; and a second end coupled to the second luminescent device; and a first detection and control unit coupled in series to first adjustable current source and configured adjust the fifth current according to the first current and the second current; and the second current controller includes:

a second adjustable current source configured to conduct sixth current; and a second detection and control unit configured adjust the sixth current according to the second current or the third current, and comprising:

a first end coupled to the second end of the first path-controller and the second adjustable current source; and a second end coupled to the second luminescent device.

15. The LED lighting device of claim 1, wherein the third current controller includes:

a third adjustable current source configured to conduct the fourth current; and a third detection and control unit coupled in series to the third adjustable current source and configured to control the third adjustable current source according to the fourth current.

16. The LED lighting device of claim 1, wherein the first path-controller includes a diode, a diode-connected field effect transistor (FET), or a diode-connected bipolar junction transistor (BJT).

17. The LED lighting device of claim 1, wherein:

the first luminescent device is coupled in parallel with the second luminescent device when the first path-controller is turned off; and the first luminescent device is coupled in series to the second luminescent device when the first path-controller is turned on.

18. The LED lighting device of claim 1, wherein:

when the first path-controller is turned off, the third current is zero, and the fourth current is equal to a sum of the first current and the second current; and when the first path-controller is turned on, the first current, the second current, the third current and the fourth current is equal.

* * * * *